US007303494B1

(12) United States Patent
Daniels

(10) Patent No.: US 7,303,494 B1
(45) Date of Patent: Dec. 4, 2007

(54) BALL HITTING TRAINING DEVICE

(76) Inventor: David D. Daniels, Lange Raam Straat 10 Rd, 2011 ZW, Haarlem (NL)

( * ) Notice: Subject to any disclaimer, the term of this patent is extended or adjusted under 35 U.S.C. 154(b) by 0 days.

(21) Appl. No.: 11/261,078

(22) Filed: Oct. 28, 2005

(51) Int. Cl.
*A63B 69/00* (2006.01)
*A63B 69/40* (2006.01)

(52) U.S. Cl. ..... 473/417; 473/422; 473/451

(58) Field of Classification Search ..... 473/422, 473/417, 419, 431, 451
See application file for complete search history.

(56) References Cited

U.S. PATENT DOCUMENTS 3,876,203 A * 4/1975 Gold ..... 473/417
3,937,464 A * 2/1976 Zalewski ..... 473/428
4,010,950 A 3/1977 Visockis
4,105,203 A 8/1978 Cho
4,699,377 A 10/1987 Ponza
4,715,238 A 12/1987 Bernardi
5,076,580 A * 12/1991 Lang ..... 473/417
5,388,823 A * 2/1995 Prieto ..... 473/417
5,494,278 A 2/1996 Linden
5,848,945 A 12/1998 Miller et al.
5,951,413 A * 9/1999 Guerriero ..... 473/417
5,997,419 A 12/1999 Daniels
6,146,289 A * 11/2000 Miller et al. ..... 473/417
6,435,989 B1 8/2002 Grubman
7,070,520 B1 7/2006 An

* cited by examiner

*Primary Examiner*—Mitra Aryanpour

(57) ABSTRACT

A ball hitting training device is disclosed for allowing a user to practice swinging a bat at a ball. The ball hitting training device includes a base assembly for resting on a support surface. A ball support assembly supports a ball to be struck by a bat swung by the user to allow the user to practice swinging the bat. The ball support assembly is coupled to the stanchion member of the stanchion assembly.

17 Claims, 6 Drawing Sheets

BALL HITTING TRAINING DEVICE

BACKGROUND OF THE INVENTION

1. Field of the Invention

The present invention relates to batting practice devices and more particularly pertains to a new ball hitting training device for allowing a user to practice swinging a bat at a ball.

2. Description of the Prior Art

The use of batting practice devices often requires the user to manually position the device in a desired location and then requires the user to position themselves in a proper location with respect to the device in order to strike the ball on the device. Often, this positioning of the user with respect to the ball on the batting practice device occurs without the user knowing if he or she is properly positioned and aligned with the ball on the device, which may cause the user to learn improper batting techniques.

Additionally, many of the known batting practice devices employ structures or mechanics for returning the ball to the player so that the ball does not have to be retrieved after each swing, or another ball needs to be positioned on the device. However, in many of these devices the return structures are exposed and may become damaged or dirty. Some known devices employ a long flexible tether coupled to the ball to facilitate returning of the ball to a starting location, but it is possible that the tether may become entangled around the bat, or even an arm of the user, and possibly cause injury to the user. Also, the tether does not always adequately control the path of the ball after being struck, and the ball may become a danger to the user or those around the user.

Thus, there is a need for a batting practice device that facilitates proper orientation of the user with respect to the ball on the device, while also providing a ball return mechanism that is effective and safe to the user and those around the user.

SUMMARY OF THE INVENTION

In view of the foregoing disadvantages inherent in the known types of batting practice devices now present in the prior art, the present invention provides a new ball hitting training device construction wherein the same can be utilized for allowing a user to practice swinging a bat at a ball.

To attain this, the present invention generally comprises a ball hitting training device for allowing a user to practice swinging a bat at a ball. The ball hitting training device includes a ball support assembly that supports a ball to be struck by a user swinging a bat to allow the user to practice swinging the bat. The ball hitting training device further includes a base assembly connected to the ball support assembly for resting on a support surface to indicate the proper positioning of the user with respect to a ball on the ball support assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
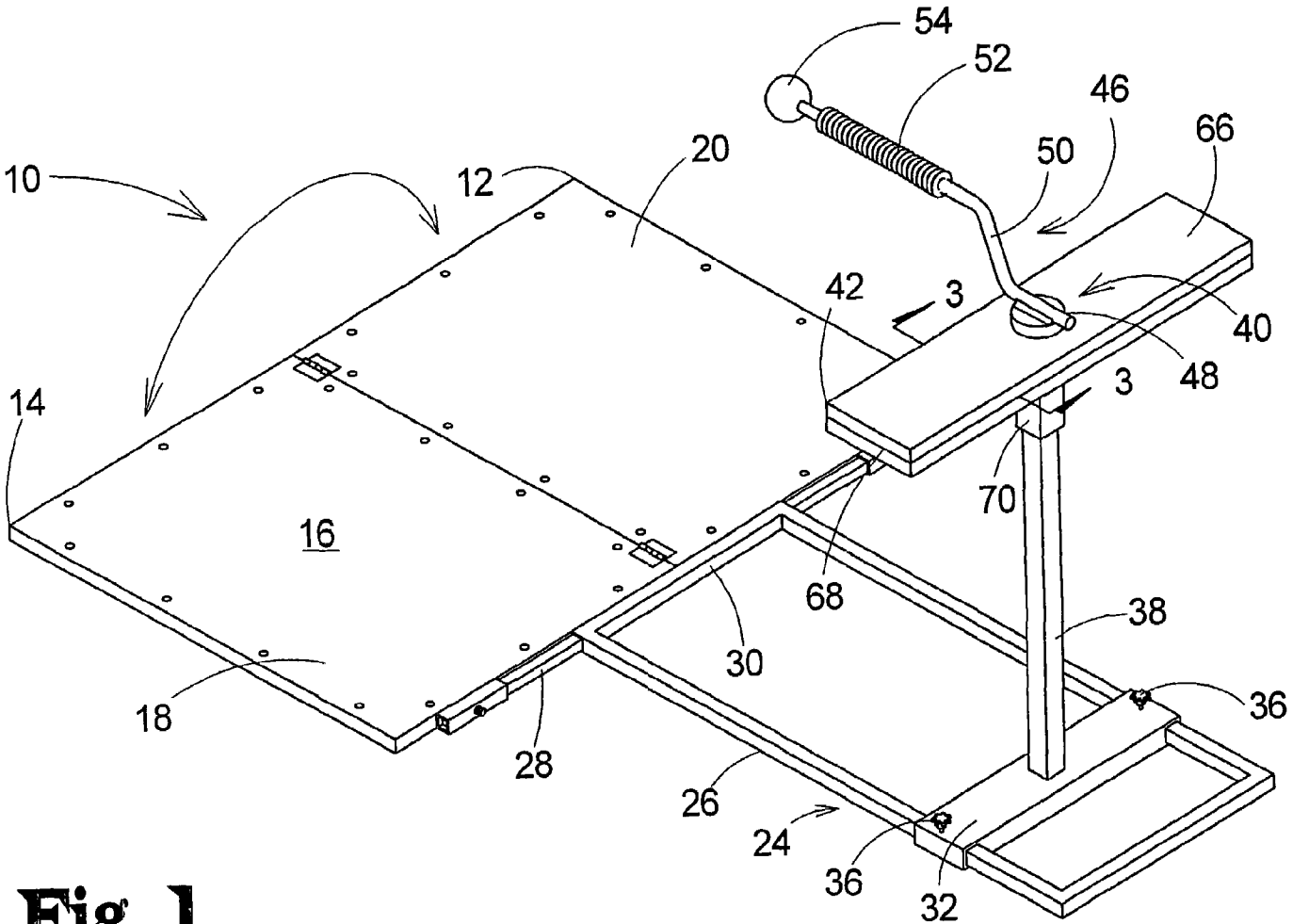
FIG. 1 is a perspective view of a new ball hitting training device according to the present invention.
Figure 2:
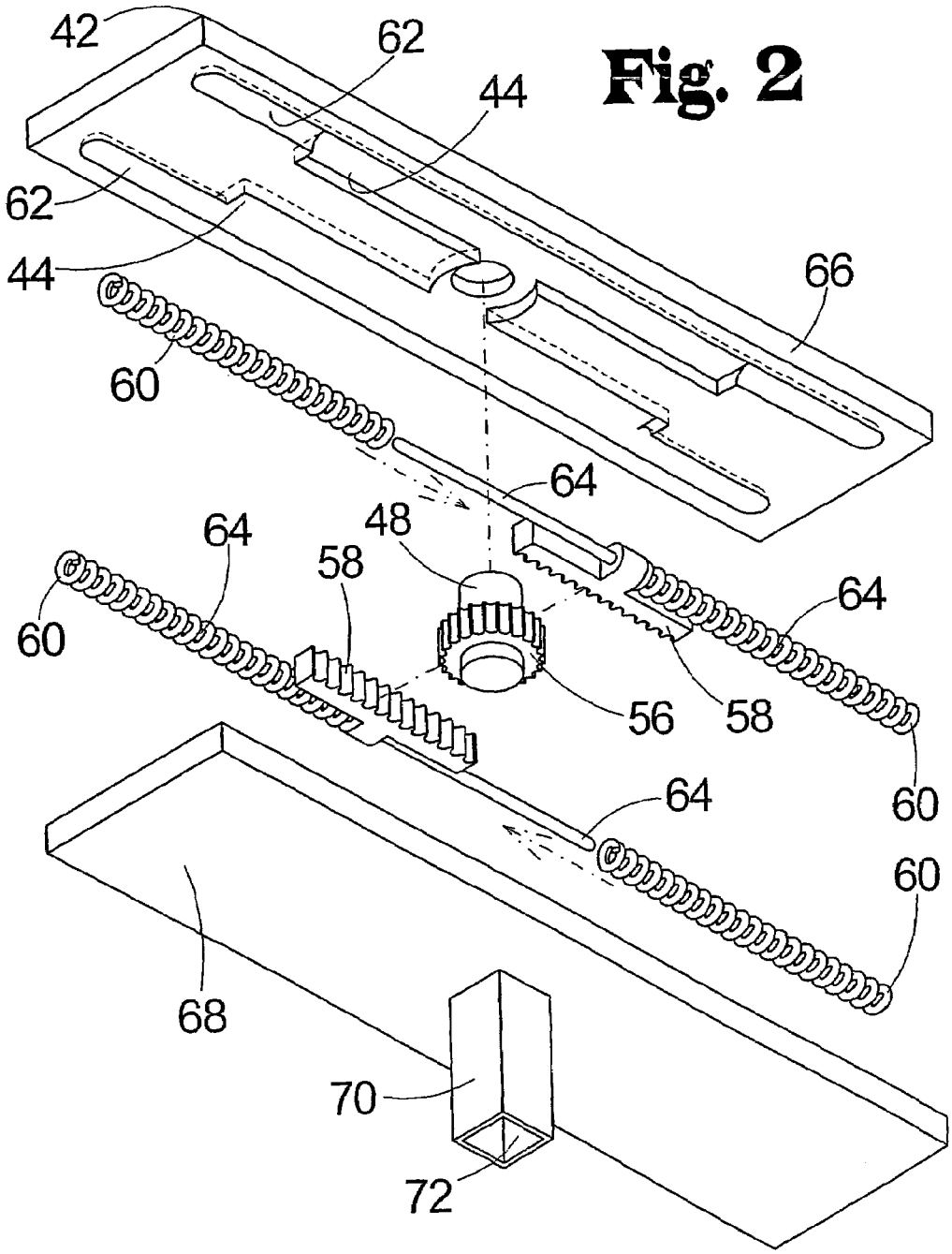
FIG. 2 is a perspective view of the upper portion and lower portion of the housing of the present invention being separated.
Figure 3:
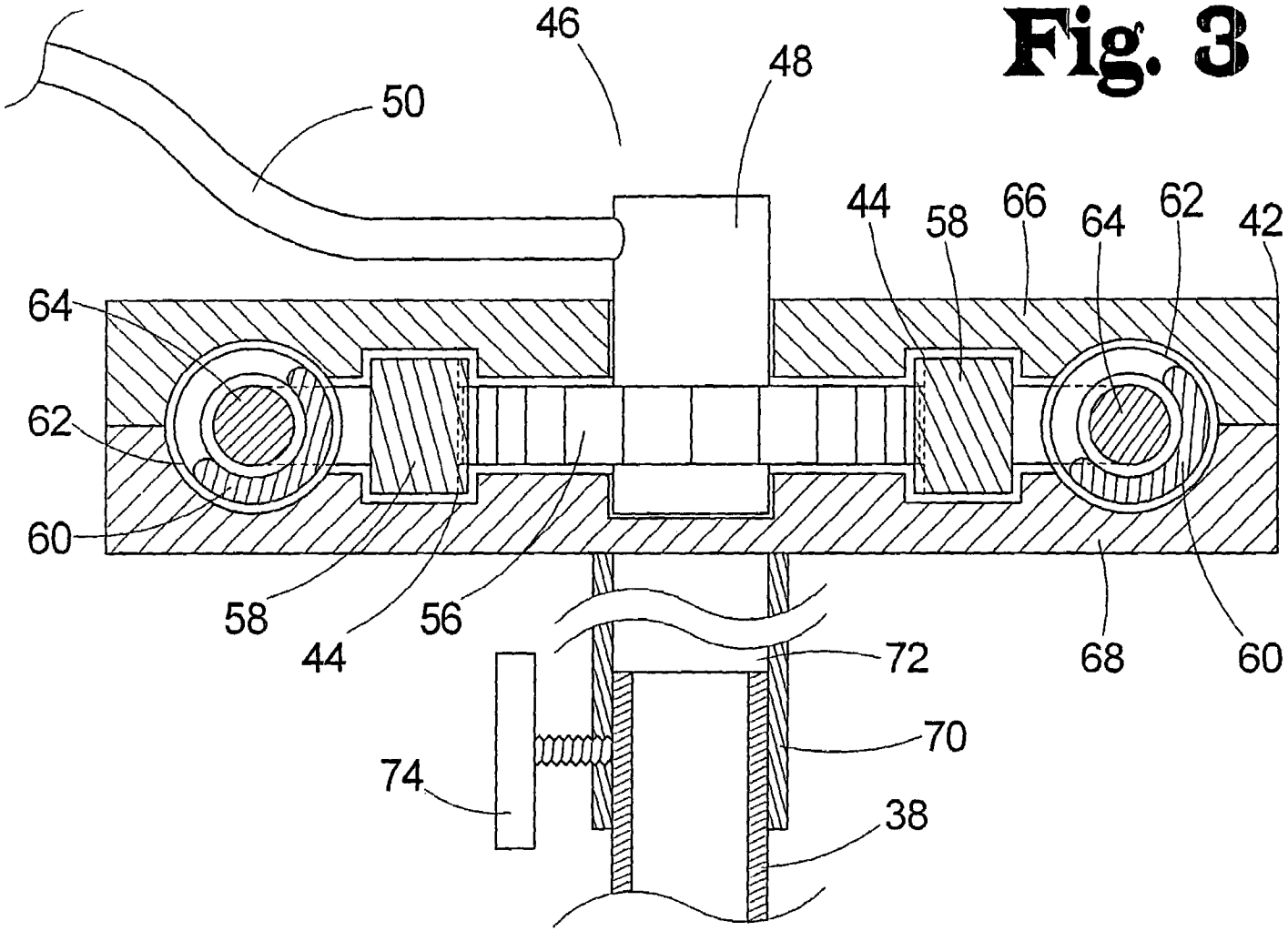
FIG. 3 is a cross-sectional view of the present invention taken along line 3-3 of FIG. 1.
Figure 4:
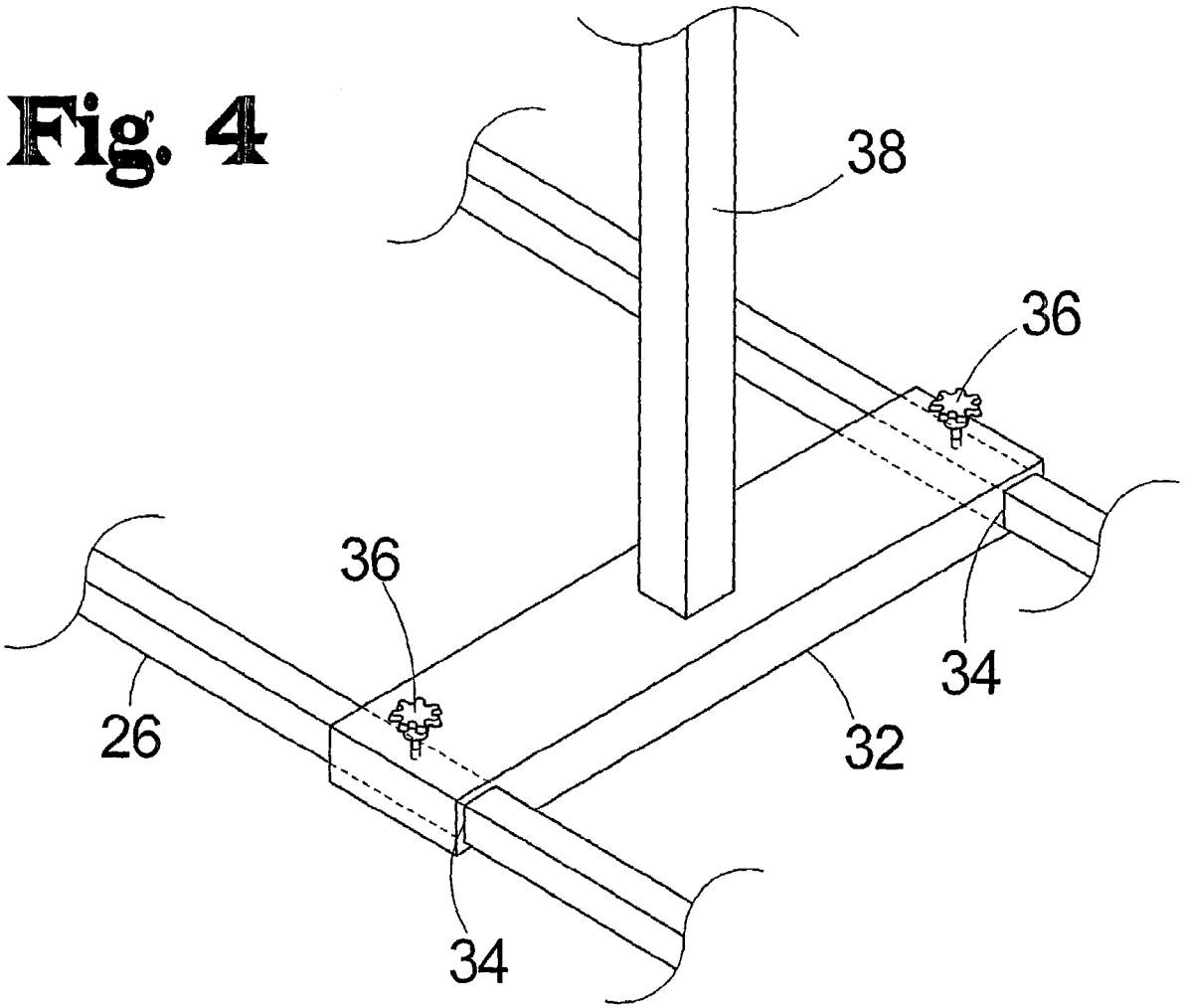
FIG. 4 is an enlarged perspective view of the frame and the adjustment member of the present invention.

With reference now to the drawings, and in particular to FIGS. 1 through 6 thereof, a new ball hitting training device embodying the principles and concepts of the present invention and generally designated by the reference numeral 10 will be described.

As best illustrated in FIGS. 1 through 6, the ball hitting training device 10 generally comprises a base assembly 12, and a ball support assembly 40 that is connected to the base assembly 12 and which supports a ball to be struck in a proper position with respect to the base indicia.

The base assembly 12 of the invention may comprise a platform 14 for positioning on the support surface. The platform 14 has an upper surface 16 thereon for a user to stand on while using the training device 10. The platform 14 may further comprise a first portion 18 and a second portion 20. The first portion 18 may include the portion of the upper surface 16 on which the user is to position himself or herself on the platform 14 during batting practice using the device 10.

The second portion 20 of the platform 14 may optionally have marked on its surface some representation of a sports device, such as, for example, a representation of a home plate (not shown), which may be represented by indicia marked on the upper surface, or any other marking that the user may want to position himself or herself relative to for practice purposes.

The second portion 20 may be hingably coupled to the first portion 18 to permit the second portion 20 to be pivoted between a deployed position and a storage position to thereby minimize the size of the platform during transport. The deployed position is defined by the second portion 20 and the first portion 18 being substantially coplanar with each other and positioned on the support surface. The storage position is defined by the second portion 20 being pivoted onto the first portion 18 (so that the upper surface of the second portion and the first portion substantially meet) whereby the first portion 18 is positioned between the second portion 20 and the support surface to minimize a footprint of the platform 14 to facilitate storage of the platform 14.

The base assembly 12 may further include a stanchion assembly 24 coupled to the platform 14 in a manner so that the stanchion assembly 24 extends away from the platform 14 along the support surface, and also upwardly away from the support surface and the plane defined by the upper surface 16 of the platform 14. The position of the stanchion assembly is preferably adjustable with respect to the platform 14 and the position of the user on the upper surface 16 on the platform. In a highly preferred embodiment, the stanchion assembly is adjustable along two substantially perpendicular axes, with one axis being oriented substantially parallel to the rear edge of the second portion of the platform 14 and the other axis being oriented substantially perpendicular to the rear edge of the second portion.

The stanchion assembly 24 comprises a frame 26 slidably mounted to the platform 14 to permit adjustment of the frame 26 horizontally with respect to the platform 14, and thus the stanchion assembly may be moved with respect to the plate indicia on the platform along an axis that extends substantially parallel to the rear edge of the plate. The stanchion assembly 24 may include a mounting bar 28 coupled to the platform 14 and oriented substantially parallel to the rear edge of the base assembly 12. The frame 26 engages and is slidably mounted to the mounting bar 28 to permit the frame 26 to slide along the length of the mounting bar, thus moving the stanchion relatively closer to and away from the plate indicia.

The stanchion assembly 24 may further include a sliding tube 30 that is coupled to the frame 26 and that slidably receives the mounting bar 28 to permit the frame 26 to be moved along the platform and be selectively positioned along a length of the mounting bar.

The stanchion assembly 24 may also comprise an adjustment member 32 slidably mounted to the frame 26 that permits adjustment of the distance between the platform 14 and the adjustment member 32, as well as the stanchion member 38. The adjustment member 32 includes a pair of apertures 34 extending along a width of the adjustment member 32. Each of the apertures 34 receives a portion of the frame 26 to permit the adjustment member 32 to slide along a portion of the length of the frame 26.

The stanchion assembly 24 may include a pair of securing members 36 that extend into an associated one of the apertures 34 in the adjustment member 32. The securing members 36 are rotatable with respect to the adjustment member 32 to adjust a length of the securing members 36 extending into the associated one of the apertures 34. The securing members 36 selectively apply force to the member of the frame 26 to increase friction between the adjustment member 32 and the frame 26 to inhibit inadvertent sliding of the adjustment member 32 with respect to the frame 26 when the securing members 36 are extended into the apertures 34.

The stanchion assembly 24 may further include a stanchion member 38 that is coupled to the adjustment member 32 whereby the stanchion member 38 extends upwardly from the adjustment member 32 and also extends substantially perpendicular to the support surface.

A ball support assembly 40 supports a ball to be struck by a bat or club or other device that is swung by the user to allow the user to practice swinging the device. The ball support assembly 40 is coupled to the stanchion member 38 of the stanchion assembly 24. The ball support assembly 40 comprises a housing 42 that is mounted to the stanchion member 38 of the stanchion assembly 24. The housing 42 is elongated with a longitudinal axis. The housing 42 defines a pair of rack channels 44 that extend substantially parallel to each other in a spaced relationship to each other.

The ball support assembly 40 further includes an armature 46 that is rotatably mounted to the housing 42. The armature 46 has a neutral position, and is rotatable out of the neutral position in opposite rotational directions. The neutral position is generally characterized by the armature 46 being oriented substantially perpendicular to the longitudinal axis of the housing 42, and generally perpendicular to the rack channels 44.

The armature 46 comprises an axle 48 that is rotatably mounted to the housing 42 so that the axle 48 rotates about an axis that may be oriented substantially perpendicular to the longitudinal axis of the housing 42, and is oriented in a generally vertical direction when the device 10 is set up for use. The axle 48 protrudes from the housing and extends upwardly from the housing 42. The armature 46 further comprises an arm 50 that is coupled to the axle 48 and that extends outwardly from the axle 48. The arm 50 extends over a side of the housing 42. The armature 46 may further comprise a biasing portion 52 that is coupled to the arm 50 at a location substantially opposite of the axle 48. A distal end 54 of the biasing portion 52 (generally opposite of the mounting of the biasing portion to the arm 50) mounts to the ball to be struck by the bat. The biasing portion 52 exhibits a degree of flexibility with respect to the arm 50, and also exhibits some resistance to bending that in turn forces the arm 50 and the axle 48 to rotate with respect to the housing 42 when the ball has been struck by a bat swung by the user. The resilience of the biasing portion 52 to bending functions to return the biasing portion and the ball into alignment with the arm 50 after the ball has been struck. The distal end 54 of the biasing portion 52 may be threaded for being screwed into the ball. In the illustrative embodiment, the biasing portion 52 comprises a helical spring, although those skilled in the art will recognize that other structures that exhibit resilient flexibility may be used.

The ball support assembly 40 may include a pinion 56 coupled to the axle 48 of the armature 46. The pinion 56 is positioned in the housing 42, and the pinion 56 is rotatable with respect to the housing 42 when the axle 48 of the armature 46 is rotated with respect to the housing 42.

The ball support assembly 40 may comprise a pair of racks 58 that are each slidably mounted in one of the pair of rack channels 44 of the housing 42. The racks 58 are in communication with the pinion 56, and engage the teeth of the pinion, with each one of the racks being positioned opposite the other one of the racks in the spaced rack channels. The racks slide along the rack channels 44 of the housing 42 when the pinion 58 is rotated by rotation of the axle 48 of the armature 46. As can be appreciated from the drawings figures, rotation of the pinion 56 causes movement of the racks 58 in opposite directions in the rack channels.

The ball support assembly 40 may further include a plurality of biasing members 60, with each of the biasing members being positioned in one of the rack channels between a portion of an associated one of the racks 58 and the housing 42 for biasing each of the racks into a starting position to reposition the armature 46 to the neutral position before the ball was struck by the bat to allow continued practice of swinging the bat at the ball. The starting position of the racks may be characterized by each of the racks being positioned substantially centrally in the associated one of the rack channels 44. Each of the biasing members 60 is positioned in an associated one of a plurality of biasing channels 62 of the housing 42 to maintain alignment of the biasing members 60 with the associated one of the racks. Each of the biasing members 60 may comprise a spring, such as a helical compression spring.

The ball support assembly 40 may include a plurality of alignment rods 64, with each alignment rod being coupled to an associated one of the racks. Each of the alignment rods 64 extend into an associated one of the biasing members 60 to maintain alignment of the biasing members 60 with the associated one of the racks.

The housing 42 may comprise an upper portion 66 and a lower portion 68, which may be oriented in a substantially clamshell arrangement. The upper portion 66 is couplable to the lower portion 68 to position the pinion 56, the racks 58, the biasing members 60 and the alignment rods 64 between the portions 66, 68 in the housing 42. The upper portion 66 and the lower portion 68 each define a portion of each of the rack channels 44 and the biasing channels 62. The upper portion 66 and the lower portion 68 are separable from each other for permitting access to the rack channels 44 and the biasing channels 62 when the lower portion 68 is separated from the upper portion 66. The axle 48 of the armature 46 is rotatably mounted to the upper portion 66 of the housing 42.

The ball support assembly 40 may further include a sleeve member 70 that is coupled to the lower portion 68 of the housing 42 so that the sleeve member 70 extends outwardly from the housing 42. The sleeve member 70 defines a lumen 72 that slidably receives the stanchion member 38 for mounting the housing 42 to the stanchion assembly 24.

The ball support assembly 40 may further include a locking member 74 that extends into the sleeve member 70 and into the lumen 72 of the sleeve member 70. The locking member 74 is rotatable with respect to the sleeve member 70 to adjust a length of the locking member 74 that extends into the lumen 72. The locking member 74 selectively applies force to the stanchion member 38 to increase friction between the sleeve member 70 and the stanchion member 38 to inhibit inadvertent removal or rotation of the sleeve member 70 with respect to the stanchion member 38 when the locking member 74 is extended into the lumen 72.

Figure 5:
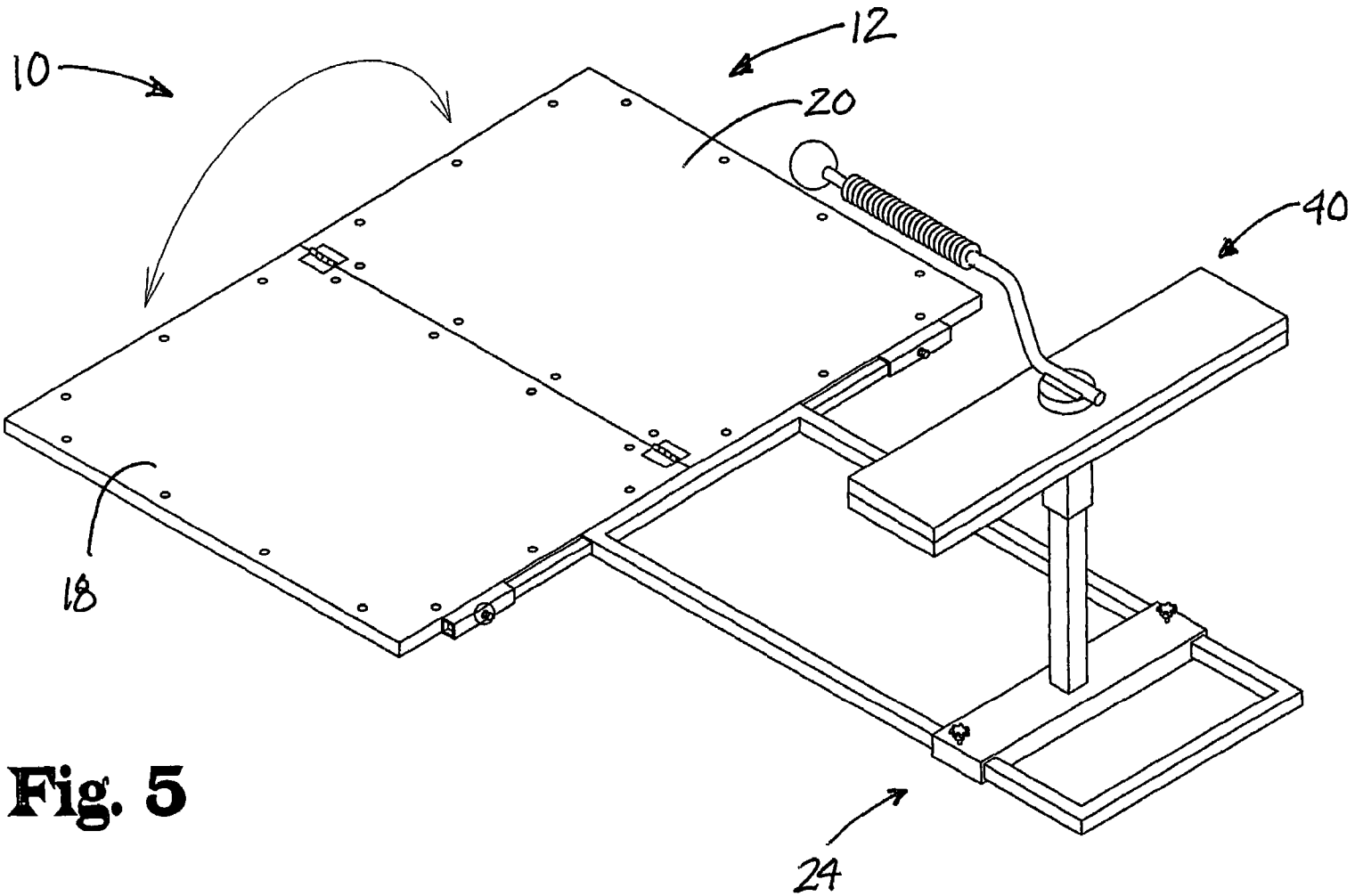
FIG. 5 is a perspective view of a variation of the mounting position of the ball support assembly of the new ball hitting training device of the present invention.
Figure 6:
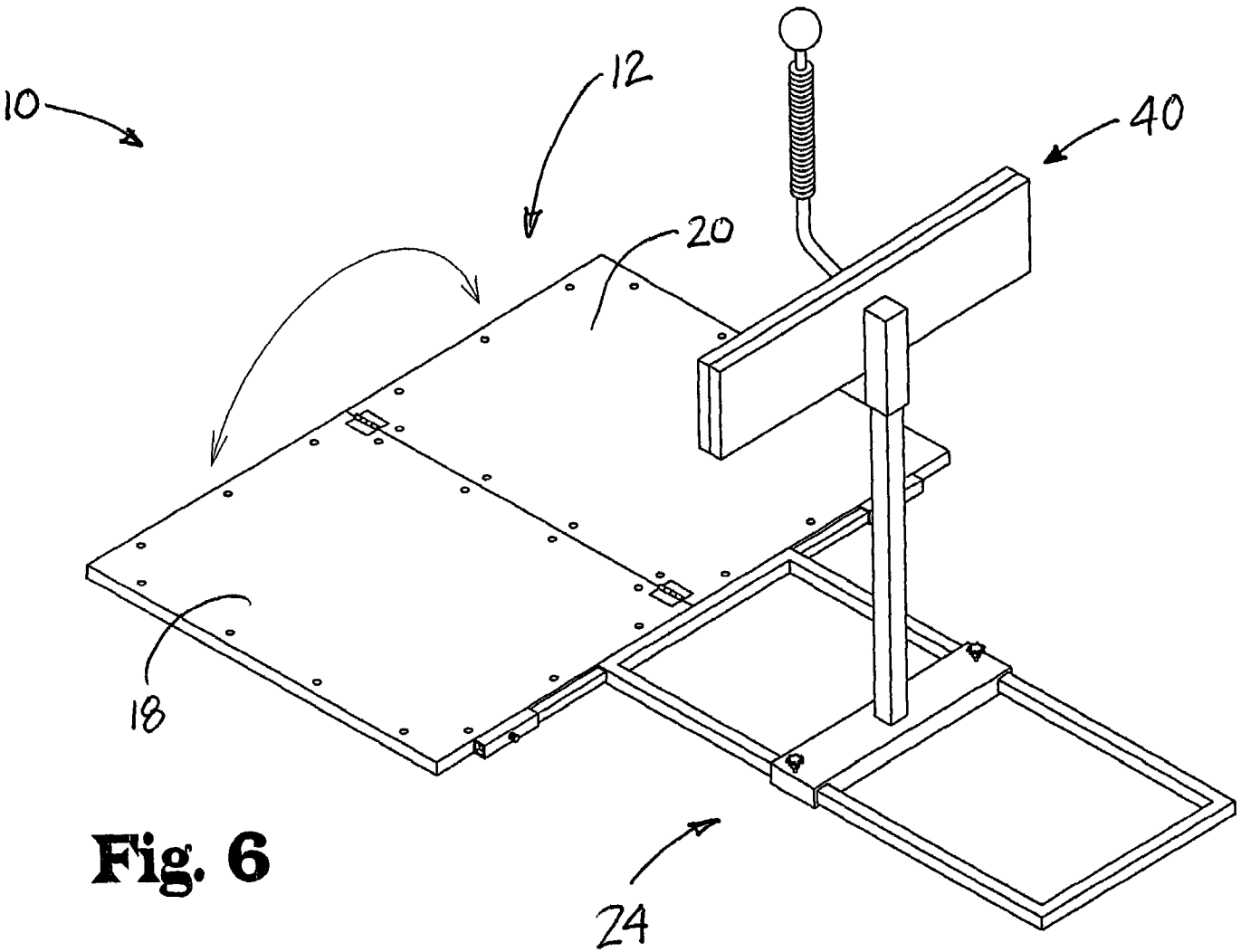
FIG. 6 is a perspective view of a second variation of the mounting position of the ball support assembly of the new ball hitting training device of the present invention.

Optionally, as shown in FIGS. 5 and 6, the position and orientation of the ball support assembly 40 may be varied for the personal preference of the user or the type of sport being practiced. As shown in FIG. 5, the ball support assembly 40 may be positioned at a relatively lower height than that height shown in FIG. 1. The position shown in FIG. 1 may be more suitable for practicing batting in American baseball, while the positioning shown in FIG. 5 may be more suitable for practicing bating for the game of cricket. As shown in FIG. 6, the orientation of the ball support assembly 40 may also be adjusted to change the path of the ball after it has been struck—i.e., a path in a vertical plane as opposed to a horizontal plane. As will be realized, both the vertical height position and the plane of movement of the ball may be adjusted, as well as the horizontal position with respect to the user by adjusting the position of the stanchion assembly 24.

In use, the user places the platform 14 on the support surface and pivots the second portion 20 of the platform with respect to the first portion 18 to the deployed position. The frame 26 of the stanchion assembly 24 is slid to a position so that the ball at the end of the armature 46 is positioned in a desired location in front of the user that is standing on the first portion 18. The adjustment member 32 is then slid along the frame 26 and secured at desired distance away from the user on the platform 14. The sleeve member 70 of the sleeve member 70 is then slid along the stanchion member 38 to position the ball at a desired height above the support surface. The user then positions himself or herself on the first portion 18 and strikes the ball with a bat. As the ball is struck, the biasing portion 52 of the armature 46 absorbs a portion of the force from the strike and directs the ball in an arcuate path around the axle 48 of the armature 46. As the armature 46 rotates the pinion 56 is rotated, which causes the racks to slid along the rack channels 44 in substantially opposite directions. A portion of the biasing members 60 of the ball support assembly 40 are compressed against the housing 42 upon this initial rotation, and then the biasing members expand or extend to move the racks back into their starting position and thereby rotate the armature 46 in an opposite direction than the arcuate path of the ball, to return the ball to initial position prior to being struck to allow the user to continue to practice swinging the bat at the ball without having to retrieve the ball, or manually reset the position of the ball after each practice swing.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Index of Elements for BALL HITTING TRAINING DEVICE

| | |
|---|---|
| 10. | BALL HITTING TRAINING DEVICE |
| 11. | |
| 12. | base assembly |
| 13. | |
| 14. | platform |
| 15. | |
| 16. | upper surface |
| 17. | |
| 18. | first portion |
| 19. | |
| 20. | second portion |
| 21. | |
| 22. | |
| 23. | |

-continued

| Index of Elements for BALL HITTING TRAINING DEVICE | |
|---|---|
| 24. | stanchion assembly |
| 25. | |
| 26. | frame |
| 27. | |
| 28. | mounting bar |
| 29. | |
| 30. | sliding member |
| 31. | |
| 32. | adjustment member |
| 33. | |
| 34. | aperture |
| 35. | |
| 36. | securing member |
| 37. | |
| 38. | stanchion member |
| 39. | |
| first | |
| 40. | ball support assembly |
| 41. | |
| 42. | housing |
| 43. | |
| 44. | rack channel |
| 45. | |
| 46. | armature |
| 47. | |
| 48. | axle |
| 49. | |
| 50. | arm |
| 51. | |
| 52. | biasing portion |
| 53. | |
| 54. | distal end |
| 55. | |
| 56. | pinion |
| 57. | |
| 58. | rack |
| 59. | |
| 60. | biasing member |
| 61. | |
| 62. | biasing channel |
| 63. | |
| 64. | alignment rod |
| 65. | |
| 66. | upper portion |
| 67. | |
| 68. | lower portion |
| 69. | |
| 70. | sleeve member |
| 71. | |
| 72. | lumen |
| 73. | |
| 74. | locking member |
| 75. | |
| 76. | |
| 77. | |
| 78. | |
| 79. | |

I claim:

1. A ball hitting trainer for allowing a user to practice hitting a ball, the ball hitting trainer comprising:

a base assembly for resting on a support surface; and a ball support assembly supporting a ball to be struck by a bat swung by the user to allow the user to practice swinging the bat; and a stanchion assembly connecting the ball support assembly to the base assembly;

wherein said ball support assembly comprises an armature that is rotatable with respect to said stanchion assembly and said base assembly, said armature having a neutral position, said armature being rotatable out of said neutral position in opposite rotational directions from said neutral position;

wherein said ball support apparatus comprises biasing means for biasing said armature toward said neutral position when said armature is rotated out of said neutral position in either of said opposite rotational directions;

wherein said ball support assembly comprises a housing mounted to said stanchion assembly, said neutral position being characterized by said armature being oriented substantially perpendicular to the longitudinal axis of said housing;

wherein said armature includes an arm, a ball being mounted on a distal end of said arm;

wherein said arm extends substantially horizontally from said housing to said ball;

wherein said armature comprises an axle rotatably mounted to said housing such that said axle rotates about an axis substantially perpendicular to the longitudinal axis of said housing, said axle extending upwardly from said housing;

wherein said biasing means of said ball support assembly comprises a pinion being coupled to said axle of said armature, said pinion being positioned in said housing such that said pinion is rotatable with respect to said housing when said axle of said armature is rotated with respect to the housing.

2. The ball hitting trainer as set forth in claim 1, wherein said ball support assembly comprises a housing mounted to said stanchion assembly, said housing defining a pair of rack channels.

3. The ball hitting trainer as set forth in claim 2, wherein said arm extends over a side of the housing.

4. A ball hitting trainer for allowing a user to practice hitting a ball, the ball hitting trainer comprising:

a base assembly for resting on a support surface; and a ball support assembly supporting a ball to be struck by a bat swung by the user to allow the user to practice swinging the bat; and a stanchion assembly connecting the ball support assembly to the base assembly;

wherein said ball support assembly comprises a housing mounted to said stanchion assembly, said housing defining a pair of rack channels;

wherein said ball support assembly comprises an armature being rotatably mounted to said housing, said armature having a neutral position, said armature being rotatable out of said neutral position, said neutral position being characterized by said armature being oriented substantially perpendicular to the longitudinal axis of said housing;

wherein said armature comprises an axle rotatably mounted to said housing such that said axle rotates about an axis substantially perpendicular to the longitudinal axis of said housing, said axle extending upwardly from said housing;

wherein said armature comprises an arm coupled to said axle and extending outwardly from said axle, said arm extending over a side of the housing;

wherein said armature comprises a biasing portion coupled to said arm opposite said axle, a distal end of said biasing portion opposite of said arm receiving a ball for being struck by the bat, said biasing portion flexing with respect to said arm and forcing said arm and said axle to rotate with respect to said housing when said ball has been struck by the bat swung by the user, said biasing portion returning said ball into alignment with said arm after said ball has been struck.

5. The ball hitting trainer as set forth in claim 1, wherein said biasing means of said ball support assembly comprises a pair of racks each slidably mounted in one of said pair of rack channels of said housing, said racks being in communication with said pinion such that one of said racks is positioned opposite the other one of said racks, said racks sliding along said rack channels of said housing when said pinion is rotated by rotation of said axle of said armature.

6. The ball hitting trainer as set forth in claim 5, wherein said biasing means of said ball support assembly comprises a plurality of biasing members each being positioned between a portion of an associated one of said racks and said housing for biasing said racks into a starting position to reposition said armature to the neutral position before said ball was struck by the bat to allow continued practice of swinging the bat at said ball, said starting position of said racks being characterized by each of said racks being positioned centrally in the associated one of said rack channels, each of said biasing members being positioned in an associated one of a plurality of biasing channels of said housing to maintain alignment of said biasing members with the associated one of said racks.

7. The ball hitting trainer as set forth in claim 6, wherein aid housing comprises an upper portion and a lower portion, said upper portion being couplable to said lower portion to position said pinion, said racks, said biasing members and said alignment rods in said housing, said upper portion and said lower portion each defining a portion of each of said rack channels and said biasing channels, said upper portion and said lower portion being separable from each other for permitting access to said rack channels and said biasing channels when said lower portion is separated from said upper portion, said pinion being rotatably mounted to said upper portion of said housing.

8. The ball hitting trainer as set forth in claim 1, wherein said base assembly comprises a platform for positioning on the support surface, said platform having an upper surface thereon for a user to stand on.

9. The ball hitting trainer as set forth in claim 8, wherein aid platform comprises a first portion including the upper surface for supporting the user when the user is positioned on said platform.

10. The ball hitting trainer as set forth in claim 9, wherein said platform further comprises a second portion being hingably coupled to said first portion to permit said first portion to be pivoted between a deployed position and a storage position, said deployed position being defined by said first portion and said second portion being substantially coplanar with each other and positioned on the support surface, said storage position being defined by said first portion being pivoted onto said second portion such that a footprint of said platform is minimized to facilitate storage of said platform.

11. The ball hitting trainer as set forth in claim 8, wherein said stanchion assembly is coupled to said platform of said base assembly such that said stanchion assembly extends upwardly away from said platform.

12. The ball hitting trainer as set forth in claim 11, wherein said stanchion assembly comprises a frame slidably mounted to said platform to permit adjustment of said frame horizontally with respect to said platform.

13. The ball hitting trainer as set forth in claim 12, wherein said stanchion assembly comprises a mounting bar coupled to said platform, said frame being slidably mounted to said mounting bar to permit said frame to slide along the length of said mounting bar.

14. The ball hitting trainer as set forth in claim 12, wherein said stanchion assembly comprises an adjustment member slidably mounted to said frame such that a distance from said platform to said adjustment member is adjustable.

15. The ball hitting trainer as set forth in claim 14, wherein said adjustment member defines a pair of apertures extending along a width of said adjustment member, each of said apertures receiving a portion of said frame to permit said adjustment member to slide along a portion of the length of said frame.

16. The ball hitting trainer as set forth in claim 14, wherein said stanchion assembly comprises a stanchion member being coupled to said adjustment member such that the stanchion member extends upwardly from said adjustment member and substantially perpendicular to the support surface; and said ball support assembly comprising a sleeve member, said sleeve member defining a lumen, said sleeve member slidably receiving said stanchion member in said lumen for mounting said housing to said stanchion assembly and permitting vertical adjustment of said ball support assembly above the support surface.

17. A ball hitting trainer for allowing a user to practice hitting a ball with a bat, the ball hitting trainer comprising:

a base assembly for resting on a support surface, said base assembly comprising:

a platform for positioning on the support surface, said platform having an upper surface thereon for a user to stand on, said platform comprising:

a first portion including the upper surface for supporting the user when the user is positioned on said platform;

a second portion being hingably coupled to said first portion to permit said first portion to be pivoted between a deployed position and a storage position, said deployed position being defined by said first portion and said second portion being substantially coplanar with each other and positioned on the support surface, said storage position being defined by said first portion being pivoted onto said second portion such that a footprint of said platform is minimized to facilitate storage of said platform;

a stanchion assembly being coupled to said platform such that said stanchion assembly extends upwardly away from said platform along the support surface, said stanchion assembly comprising:

a frame slidably mounted to said platform to permit adjustment of said frame horizontally with respect to said platform;

a mounting bar coupled to said platform, said frame being slidably mounted to said mounting bar to permit said frame to slide along the length of said mounting bar;

a sliding tube being coupled said frame, said sliding tube slidably receiving said mounting bar to permit said frame to be selectively positioned along a length of said mounting bar;

an adjustment member slidably mounted to said frame such that a distance from said platform to said adjustment member is adjustable, said adjustment member defining a pair of apertures extending along a width of said adjustment member, each of said apertures receiving a portion of said frame to permit said adjustment member to slide along a portion of the length of said frame;

a pair of securing members extending through an associated one of said apertures in said adjustment member, said securing members being rotatable with respect to said adjustment member to adjust a length of said securing members extending into the associated one of said apertures, said securing members selectively applying force to said frame member to increase friction between said adjustment member and said frame to inhibit inadvertent sliding of said adjustment member with respect to said frame when said securing members are extended into said apertures;

a stanchion member being coupled to said adjustment member such that the stanchion member extends upwardly from said adjustment member and substantially perpendicular to the support surface;

a ball support assembly supporting a ball to be struck by a bat swung by the user to allow the user to practice swinging the bat, said ball support assembly being coupled to said stanchion member of said stanchion assembly, said ball support assembly comprising:

a housing mounted to said stanchion member of said stanchion assembly, said housing being elongated with a longitudinal axis, said housing defining a pair of rack channels;

an armature being rotatably mounted to said housing, said armature having a neutral position, said armature being rotatable out of said neutral position, said neutral position being characterized by said armature being oriented substantially perpendicular to the longitudinal axis of said housing, said armature comprising:

an axle rotatably mounted to said housing such that said axle rotates about an axis substantially perpendicular to the longitudinal axis of said housing, said axle extending upwardly from said housing;

an arm coupled to said axle and extending outwardly from said axle, said arm extending over a side of the housing;

a biasing portion coupled to said arm opposite said axle, a distal end of said biasing portion opposite of said arm receiving a ball for being struck by the bat, said biasing portion flexing with respect to said arm and forcing said arm and said axle to rotate with respect to said housing when said ball has been struck by the bat swung by the user, said biasing portion returning said ball into alignment with said arm after said ball has been struck, said distal end of said biasing portion being threaded for threadably engaging said ball, said biasing portion comprising a spring;

a pinion being coupled to said axle of said armature, said pinion being positioned in said housing such that said pinion is rotatable with respect to said housing when said axle of said armature is rotated with respect to the housing;

a pair of racks each slidably mounted in one of said pair of rack channels of said housing, said racks being in communication with said pinion such that one of said racks is positioned opposite the other one of said racks, said racks sliding along said rack channels of said housing when said pinion is rotated by rotation of said axle of said armature;

each of a plurality of biasing members being positioned between a portion of an associated one of said racks and said housing for biasing said racks into a starting position to reposition said armature to the neutral position before said ball was struck by the bat to allow continued practice of swinging the bat at said ball, said starting position of said racks being characterized by each of said racks being positioned centrally in the associated one of said rack channels, each of said biasing members being positioned in an associated one of a plurality of biasing channels of said housing to maintain alignment of said biasing members with the associated one of said racks, each of said biasing members comprising a spring;

each of a plurality of alignment rods being coupled to an associated one of said racks, each of said alignment rods extending into an associated one of said biasing members to maintain alignment of said biasing members with the associated one of said racks;

said housing comprising an upper portion and a lower portion, said upper portion being couplable to said lower portion to position said pinion, said racks, said biasing members and said alignment rods in said housing, said upper portion and said lower portion each defining a portion of each of said rack channels and said biasing channels, said upper portion and said lower portion being separable from each other for permitting access to said rack channels and said biasing channels when said lower portion is separated from said upper portion, said axle of said armature being rotatably mounted to said upper portion of said housing;

a sleeve member being coupled to said lower portion of said housing such that said sleeve member extends outwardly from said housing, said sleeve member defining a lumen, said sleeve member slidably receiving said stanchion member for mounting said housing to said stanchion assembly;

a locking member extending through said sleeve member and into the lumen of said sleeve member, said locking member being rotatable with respect to said sleeve member to adjust a length of said locking member extending into said lumen, said locking member selectively applying force to said stanchion member to increase friction between said sleeve member and said stanchion member to inhibit inadvertent sliding of said sleeve member with respect to said stanchion member when said locking member is extended into said lumen.

* * * * *